US006305877B1

(12) United States Patent
Cavanagh

(10) Patent No.: US 6,305,877 B1
(45) Date of Patent: Oct. 23, 2001

(54) BREAKWATER/ATTENUATION DEVICE FOR HIGH SPEED VESSEL WAKE

(75) Inventor: Richard A. Cavanagh, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/519,629

(22) Filed: Mar. 6, 2000

(51) Int. Cl.[7] ..... E02B 3/04; E02B 3/06

(52) U.S. Cl. ..... 405/26; 405/21; 405/22; 405/31; 405/27

(58) Field of Search ..... 405/21, 22, 25, 405/26, 28, 76, 30, 31, 27

(56) References Cited

U.S. PATENT DOCUMENTS

| | | | | |
|---|---|---|---|---|
| 1,507,461 | * | 9/1924 | Chase | 405/26 |
| 2,185,458 | * | 1/1940 | Giliasso | 405/26 |
| 4,234,266 | * | 11/1980 | Angioletti | 405/26 |
| 5,178,489 | * | 1/1993 | Suhayda | 405/21 |
| 5,294,211 | * | 3/1994 | Numura | 405/28 |
| 5,645,371 | * | 7/1997 | Marzullo | 405/21 |
| 5,655,851 | * | 8/1997 | Chor | 405/31 |
| 5,707,172 | * | 1/1998 | Wilcox | 405/26 |
| 5,827,011 | * | 10/1998 | Kann | 405/27 |
| 5,863,150 | * | 1/1999 | Wells | 405/31 |
| 6,102,616 | * | 8/2000 | Foote | 405/26 |

FOREIGN PATENT DOCUMENTS

| | | | | |
|---|---|---|---|---|
| 2584748-A1 | * | 1/1987 | (FR) | E02B/3/06 |
| 56016715-A | * | 2/1981 | (JP) | E02B/3/06 |
| 60051210-A | * | 3/1985 | (JP) | E02B/3/06 |
| 60088707-A | * | 5/1985 | (JP) | E02B/3/06 |
| 62117907-A | * | 5/1987 | (JP) | E02B/3/06 |
| 63130809-A | * | 6/1988 | (JP) | E02B/3/06 |

* cited by examiner

*Primary Examiner*—Thomas B. Will
*Assistant Examiner*—Alexandra K. Pechhold
(74) *Attorney, Agent, or Firm*—Harvey A. Gilbert; Donald G. Peck

(57) ABSTRACT

A barrier dissipates energy from wakes from high speed vessels. Pilings embedded in the seabed slidably extend through openings in a flotation section below the surface of the water and through apertures in a gate section above the surface of the water. Struts on the flotation section extend through the surface of the water to hold the gate section a predetermined height above the surface. An inclined ramp extends from the flotation section below the surface and progressively reduces the depth of the water above the ramp portion as the distance to the flotation section becomes less. The progressively reduced depth builds-up the incoming wake, and the gate section cuts off the crest of the built-up wake to dissipate energy. Systems of barriers may be located in various patterns of spaced apart arrangements along waterways to intercept and reduce the effects of wakes produced by numerous high speed vessels. This spaced apart arrangement dissipates the energy of the wakes yet permits passage of water traffic, fish feeding patterns and/or migrations, water flow, biomass transport, flotsam and jetsam, and natural and manmade events. The barrier is relatively unaffected by swells, conventional waves, and tidal flow.

12 Claims, 3 Drawing Sheets

BREAKWATER/ATTENUATION DEVICE FOR HIGH SPEED VESSEL WAKE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to devices that reduce the possibility of damage from wakes from vessels. More particularly, this invention dissipates the energy of wakes produced by high speed vessels.

Air cushion vehicles like the landing craft air cushion (LCAC), hydrofoils, surface effect ships, and wave piercing vessels have produced wakes during their high speed transit for as long as they have been around. While, at the very least, these wakes are annoying, they are dangerous and can damage moored craft and installations in shallower regions near the water's edge and can erode unprotected stretches of shoreline.

Research has proven that when high speed vessels reach a critical speed, a soliton, or solitary wave, is produced by the bow, and it has been observed in test tanks or confined areas of water such as canals. The solitary wave of the wake has a crest, or peak, above the water, but no trough and carries significant energy so that it is often referred to as a "mini tsunami." These solitary waves are actually a movement of water, as compared to a conventional wave that has a crest and a trough and surges and retreats at the shore. Despite their power, the solitary waves may be only a couple of centimeters high in the deep ocean, however; when they come into shallower water, they build in size and steepen-up to become like a tsunami in shallow water. Consequently, solitary waves, or wakes build up as a function of not only the speed of the vessel that produces them but also the depth of the water that they are passing through. While nearly all boats produce solitary waves of different magnitudes, the solitary waves produced by high speed ferries and LCACs are particularly destructive in bays, straits, and other shallow regions adjacent water passageways.

Under maritime law, owners of vessels are legally responsible for the wakes of their vessels. Admiralty claims are often filed for damage caused by wakes from high speed vessels. One way to avoid these claims, of course, is to reduce the speed, but lower speed operation compromises one of the strongest features for using these types of vessels. The speed of the high speed ferry Chinook which shuttles crew members from vessels between Bremerton and Everett Washington has been slowed to 12 knots when it passes through Rich Passage, and passenger ferries between the UK and the Netherlands have been both rerouted and transit at lower speeds.

Thus, in accordance with this inventive concept, a need has been recognized in the state of the art for a barrier that dissipates the energy of wakes in shallow regions along transit routes of high speed

SUMMARY OF THE INVENTION

The present invention provides a barrier that dissipates energy from the wake from a high speed vessel. Pilings reach upward from the seabed and slidably extend through openings in a flotation section below the surface of the water and through apertures in a gate section above the surface of the water. Struts on the flotation section extend through the surface of the water to hold the gate section a predetermined height above the surface. An inclined ramp extends from the flotation section below the surface and progressively reduces the depth of the water above the ramp portion as the distance to the flotation section becomes less. The progressively reduced depth builds-up the incoming wake, and the gate section cuts off the crest of the built-up wake to dissipate energy.

An object of the invention is to provide a barrier for the energy of wakes of high speed vessels.

Another object of the invention is to reduce the destructive effects of wakes having characteristics of solitary waves, or "mini tsunamis."

Another object of the invention is to provide a barrier that reduces the energy of wakes along waterways for high speed vessels.

Another object is to provide floating structure beneath the water's surface supporting gate structure above the water to clip-off crests of wakes of vessels.

Another object of the invention is to provide piling guided floating structure that clips-off and dissipates energy from wakes.

Another object of the invention is to provide a barrier to dissipate the energy from wakes of high speed ships that permits passage of water traffic, fish feeding patterns and/or migrations, water flow, biomass transport, flotsam and jetsam, and natural and manmade events.

Another object of the invention is to provide a system of barriers for the energy of boat wakes arranged to not interfere with other activities associated with ocean waterways and shore regions.

Another object of the invention is to provide a barrier system to dissipate the energy from wakes of high speed ships that is relatively unaffected by swells, conventional waves, and tidal flow.

Another object of the invention is to provide a cost-effective barrier system for wakes from high speed vessels that may be placed and oriented and/or relocated and reoriented to accommodate changing boat traffic patterns.

Another object of the invention is to provide floating barrier structure slidably mounted on pilings driven into the seabed.

Another object of the invention is to provide floating barrier structure having a wall section supported above the water by a flotation section provided with an inclined ramp to build up the shape of impinging wakes.

These and other objects of the invention will become more readily apparent from the ensuing specification when taken in conjunction with the appended claims.

DESCRIPTION OF THE PREFERRED EMBODIMENT

Figure 1:
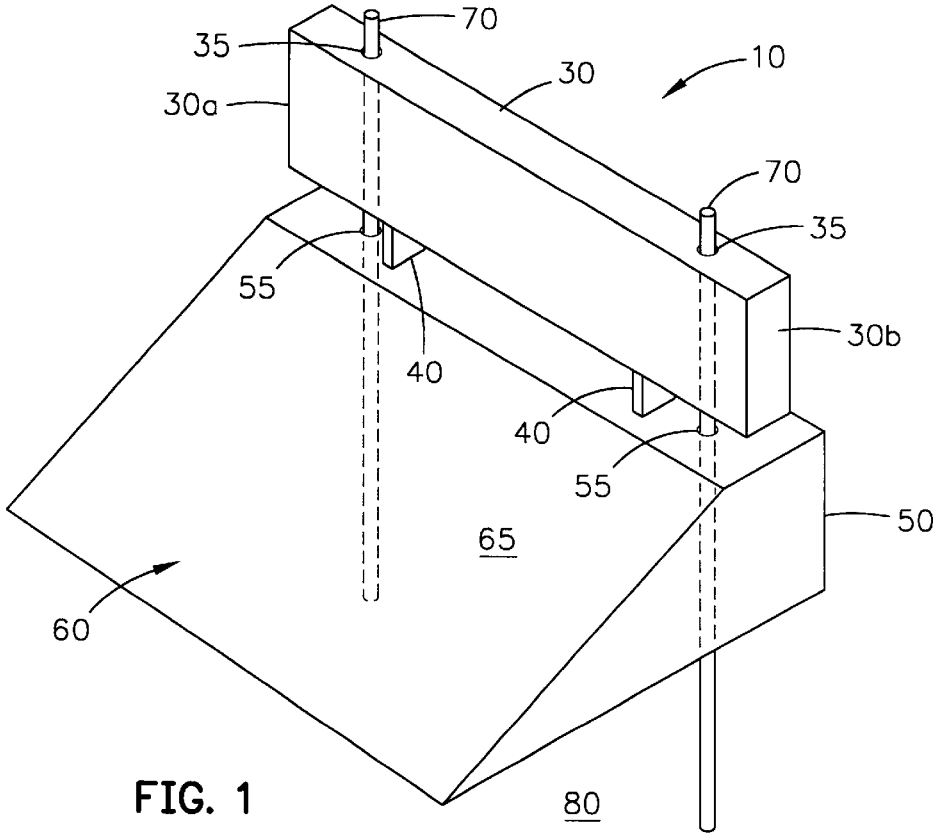
FIG. 1 isometrically shows a barrier for solitary waves of wakes of high speed vessels in accordance with this invention.
Figure 2:
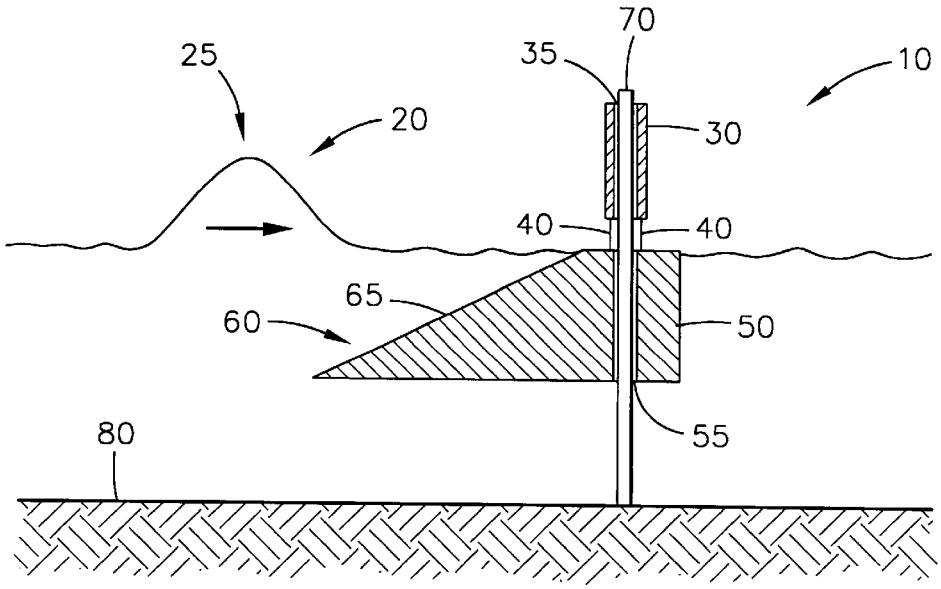
FIG. 2 is a side view of the wake from a high speed vessel moving toward the shoreline and approaching the barrier of this invention.

Referring now to FIGS. 1 and 2, barrier 10 of this invention is an attenuation/breakwater that dissipates the energy of solitary waves of wakes from high speed vessels. Consequently, barrier 10 protects marine properties and installations, as well as marine features, such as shorelines from damage, and prevents injury to those in near-shore regions from damage and injury that might otherwise be sustained. Single and multiple barriers 10 can be arranged in and along shore regions of waterways where high speed vessels transit. This arrangement assures the dissipation of the otherwise destructive energies of their wakes so that the vessels can efficiently proceed at the higher and more efficient speeds for which they were designed.

A well-known side-effect of operation of a high speed vessel is that during transit it produces a wake 20 in the form of a solitary wave. It has been discovered that the solitary wave of wake 20 is much like a "mini tsunami." Wake 20 is an actual movement of a volume of water that has a crest 25 but no trough on either side, and the movement of water of wakes 20 therefore is unlike classical waves which are pressure pulses. The volume of water of wake 20 builds-up crest 25 as wake 20 travels into shallower waters. As a result, crest 25 has considerable energy that may be inordinately destructive as it approaches shallow regions, or shallows that are usually found near the shoreline.

Barrier 10 of this invention clips-off crest 25 and dissipates the energy of each and every wake 20 without disrupting small boats, fish and other marine life, tidal flow, etc. An elongate gate section 30 is supported a predetermined height above the surface of the water by a number of elongate struts 40 that extend from flotation section 50 and through the water-air interface. Elongate struts 40 and flotation section 50 may be one or more hollow and/or compartmented watertight structures or may be made from otherwise buoyant building materials, such as solid and/or compartmented cast foam materials that produce overall structures that produce sufficient buoyancy.

Flotation section 50 is disposed below the surface of the water so that its upper surface may be below, just to, or at the water-air interface. Flotation section 50 has an inclined ramp portion 60 that extends away and down from it to define an upper rampway 65 that has less and less water over it (gets shallower) as flotation section 50 and gate section 30 are approached.

Inclined ramp 60 may be a hollow structure or otherwise buoyant so that the combined, or composite buoyancy of elongate struts 40, flotation section 50, and inclined ramp 60 holds elongate gate section 30 the predetermined distance, or height above the surface of the water. Just how far this height is to be, is determined by 1.) the expected magnitude of impinging wakes 20 from passing high speed vessels and 2.) the amount of crest 25 of each wake 20 that will be clipped-off (as will be elaborated-on below).

A plurality of pilings 70 is securely driven into or otherwise suitably secured, or embedded in seabed 80. Seabed 80 where pilings 70 are embedded is near a waterway where high speed vessels create wakes 20 and adjacent or at shallows or near-shore regions where the effects of wakes 20 are sought to be reduced.

A plurality of apertures 35 and openings 55 is provided to extend through gate section 30 and flotation section 50, respectively, and individual ones of apertures 35 and openings 55 are aligned with one another in aligned pairs. The aligned pairs of apertures 35 and openings 55 are sized to slidably receive separate ones of pilings 70.

Pilings 70 are fitted loosely enough through apertures 35 of gate section 30 and openings 55 in flotation section 50 to permit gate section 30 and flotation section 50 with inclined ramp portion 60 to slide, or ride up and down pilings 70 as changes in the water level occur. These changes of water level may be attributed to storm surge, tidal flow, and other conventional waves, for examples. However, pilings 70 fit snugly enough through apertures 35 and openings 55 to hold elongate gate section 30 substantially vertically above flotation section 50 and to hold inclined ramp 60 extending to the side from flotation section 50 and beneath the surface of the water.

Although a single row of two pilings 70 is shown in the drawings, it is to be understood that more rows of different numbers of pilings 70 could be used in some applications. Cables (not shown) may be connected to the tops of each of pilings 70 and anchored in the seabed to help bear up against the effects of strong winds, excessive surge, and wave action that accompany higher sea states.

Ballast tank structures, water pumps, compressed air machinery, and appropriate control modules can be included where needed in the aforedescribed constituents of barrier 10, and a network of lines and ducts for air and water, power sources, and associated equipments can be provided for.

The relative displacement and buoyancy of elongate struts 40 where they extend through the water-air interface is relatively small as compared to flotation section 50 and inclined ramp 60. This keeps flotation section 50 and inclined ramp 60 of barrier 10 located beneath the surface of the water and elongate gate section 30 held the predetermined height above the surface of the water. Fluctuations of the water level of incoming wakes 20 on elongate struts 40, therefore, produce relatively small heaving forces as compared to the stable buoyant forces produced by flotation section 50 and inclined ramp 60. Thus, the arrangement of barrier 10 works like a spar buoy, and any tendency for wakes 20 to move elongate struts 40 and gate section 30 up and down on pilings 70 is reduced.

Elongate struts 40 can be selectably extendible or retractable to change their displacement and/or to place elongate gate section 30 at the right height above the surface of the water. This capability assures that the right amount of crests 25 are clipped from differently sized wakes 20.

Figure 3:
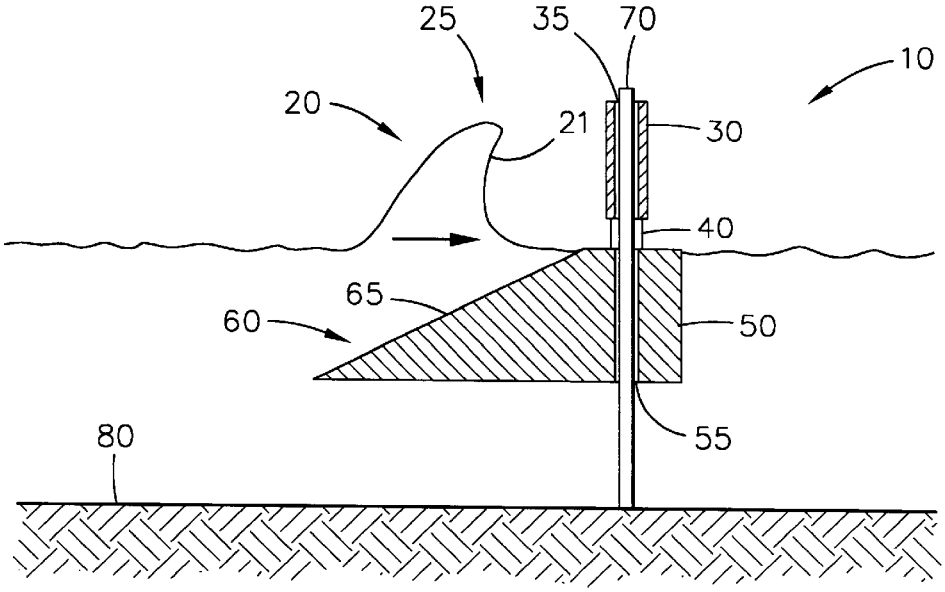
FIG. 3 is a side view showing the wake being built-up as it progresses up the inclined ramp.

Noting FIG. 2, a passing high speed vessel creates wake 20 that travels from the left and approaches inclined ramp 60. If wake 20 is created or passes through deeper water, wake 20 may not be noticeable at all, or at most may appear to be a slight bulge measuring only one or two centimeters high. As wake 20 continues to travel to the right and up inclined ramp 60, the progressively shallower water depth above upper rampway 65 causes crest 25 to stand-up, or build up in size so that its face 21 becomes steeper, also see FIG. 3.

Figure 4:
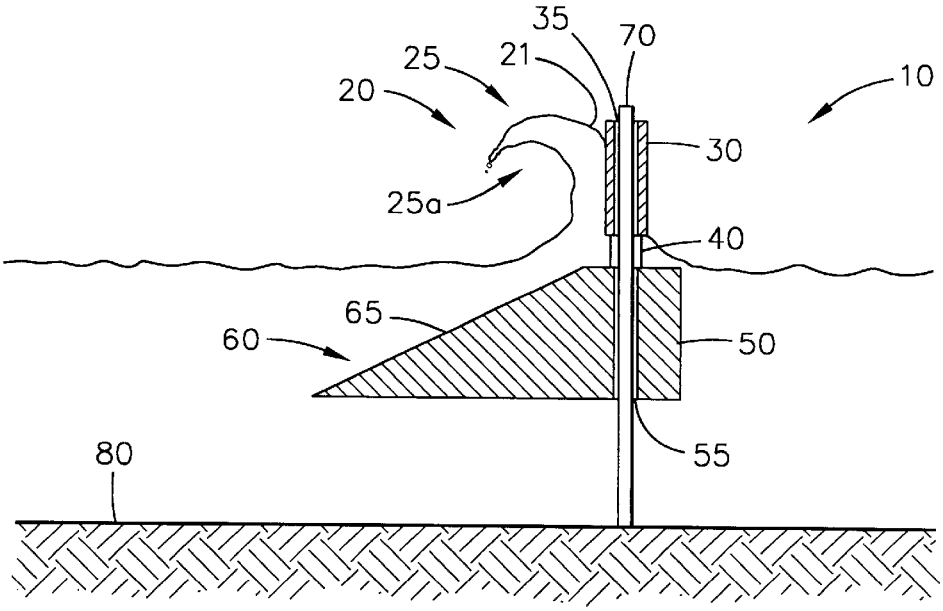
FIG. 4 is a side view showing the built-up wake at the top of the inclined ramp at the flotation section and impacting the wall section which clips-off the crest.

Further travel of wake 20 up inclined ramp 60 causes crest 25 with its steep face 21 to impact the flat surface of gate section 30, also see FIG. 4. The considerable lateral and vertical expanse of gate section 30 causes a significant dissipation of energy of wake 20 when it impacts. This impact knocks-off, or clips-off portion 25*a* of crest 25 of wake 20, and, thus, gate section 30 removes potentially damaging longitudinal energy from wake 20.

Figure 5:
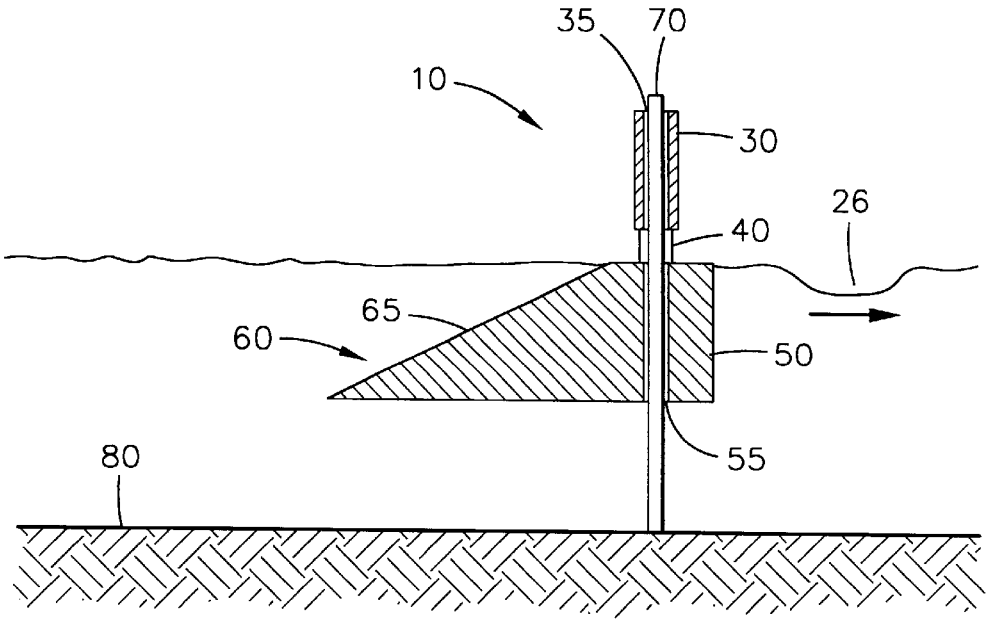
FIG. 5 is a side view of the wake showing a depression, or hole where its clipped-off crest was and proceeding toward the shore with a considerable part of its energy dissipated.

As wake 20 continuous to move to the right and past barrier 10, the clipped-off portion 25*a* of wake 20 creates a "hole," or depression 26, also see FIG. 5. Now, the water on the sides of depression 26 flows in to fill it. As the water flows in from the sides of depression 26, the lateral forces counter each other to effect further removal of energy of wake 20.

Some parts (not shown) of crest 25 of wake 20 pass by ends 30*a* and 30*b* of gate section 30 (see FIG. 1) to additionally dissipate potential longitudinal energy. These parts of crest 25 of wake 20 that move past ends 30*a* and 30*b* form eddies, or eddy currents to the right of gate section 30 of barrier 10 in much the same manner as eddies are formed behind rocks in a flowing stream. These eddy currents additionally dissipate energy from wake 20 in the form of rotational energy at the right of barrier 10.

Barrier 10 is fabricated from appropriate noncorrosive, or corrosion resistant construction materials in accordance with sound marine engineering principles to withstand the rigors of the harsh marine environment. Suitable construction and reinforcing techniques are followed throughout to produce barriers 10 that may be unattended to reliably dissipate energy for prolonged durations.

Barrier system 10 of this invention removes otherwise destructive energies from wakes 20 of high speed vessels by attacking the wakes' characteristics of being solitary waves with "tops"(or crests 25) but without "bottoms," (or troughs) to remove energy from them in multiple waves. This feature allows a more efficient use of structure of barrier 10 as compared to other breakwater techniques. Furthermore, barrier system 10 can significantly reduce the disruptive and dangerous force of wakes from high speed vessels without disrupting water traffic, fish migration and feeding patterns, biomass, flotsam, and jetsam transport or other natural or manmade activities.

optionally, barrier system 10 might be made to have a higher elongate gate section 30 to create a solid breakwater that may run from the bottom to a height equal to the high water line and wave/wake height. However, this modification may be prohibitively expensive and disruptive to the environment and traffic flow.

A system of barriers 10 of this invention may be located in various patterns along waterways to intercept wakes and reduce the effects of wakes produced by numerous high speed vessels. For example, barriers 10 might be arranged in staggered and spaced apart rows and columns, and pilings 70 are appropriately positioned so that inclined ramps 60 of barriers 10 are pointed toward the trafficked areas where the wakes are created. This spaced apart arrangement dissipates the energy of the wakes yet permits passage of water traffic, fish feeding patterns and/or migrations, water flow, biomass transport, flotsam and jetsam, and natural and manmade events. The manner of slidably situating barriers 10 on the seabed with pilings 70 allows dissipation of the energy from wakes of high speed ships, yet barriers 10 are relatively unaffected by swells, conventional waves, and tidal flow. In addition to reducing the effects of wakes, barriers 10 of this invention may also simultaneously serve as the support structure for radar sites, relay stations, navigational aids, etc. Engineers and planners can modify these arrangements of barriers 10 and add-to, take-from, move, and/or reorient them to accommodate changes in these and other activities associated with ocean waterways and shore regions.

Barriers 10 are cost-effective alternatives to other ways of countering the effects of wakes. After vessels that have produced wakes stop running, change their routes, or otherwise no longer present problems, barriers 10 with their pilings 70 may be removed from an area where they had been needed. The removed barriers 10 and pilings 70 can be relocated to another, distant area where they might be required, or the removed barriers might be stored for a while and reinstalled when the hazardous condition reappears.

Having the teachings of this invention in mind, modifications and alternate embodiments of this invention may be adapted. For examples, the shapes of gate sections 30 could be changed to reflect and/or dissipate different wakes; more pilings 70 might be needed to maintain barrier 10 in the seabed; inclined ramp 60 may be only a flat surface with no additional buoyancy capability; different construction materials may have to be used in the constituents of barrier 10 to more favorably survive some work sites in the ocean; suitable lubrication and antifouling schemes may have to be incorporated for reliable operation; and heating or cooling systems may be needed to combat ice build up in polar regions or prevent rot and/or combustion in tropical regions.

The disclosed components and their arrangements as disclosed herein all contribute to the novel features of this invention. This invention provides a cost-effective way to dissipate the effects of wakes from high speed vessels. Therefore, barrier 10, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

I claim:

1. A barrier for wakes comprising:

pilings embedded in seabed of a body of water and extending upward through the surface of said water;

a flotation section disposed below said surface of said water having openings to each slidably receive one of said pilings therethrough to permit vertical displacement thereon;

a gate section above said surface of said water having apertures aligned with said openings to each slidably receive one of said pilings therethrough, said gate section having an expanse to dissipate energy from wakes from high speed vessels; and struts connected to said flotation section and said gate section to extend through said surface of said water and to hold said gate section above said flotation section, said struts and said flotation section having composite buoyancy to hold said gate section a predetermined distance above said surface of said water.

2. An apparatus according to claim 1 in which said pilings are embedded in said seabed between deeper and shallower regions of said water and said expanse of said gate section has both lateral and vertical extent to clip-off crests of said wakes and thereby dissipate said energy.

3. An apparatus according to claim 2 further comprising:

an inclined ramp portion extending from said flotation section below said surface of said water, said inclined ramp portion progressively reducing the depth of water above it as the distance to said flotation section becomes less to build up an incoming wake and assure clipping-off of said crests by said gate section.

4. An apparatus according to claim 3 in which said pilings are oriented to present said inclined ramp portion toward a region of said water where said high speed vessels create said wakes.

5. An apparatus according to claim 4 in which said inclined ramp portion contributes to said composite buoyancy to hold said gate section said predetermined distance above said surface of said water.

6. A system to dissipate energy from wakes created by high-speed vessels comprising:

a plurality of barriers disposed between a waterway region for transiting high-speed vessels and near-shore regions, said barriers being separated from one another to permit passage of vessels and marine life and facing to dissipate energy of wakes from high speed vessels, each barrier including;

pilings embedded in seabed and extending upward through the surface of water, a flotation section disposed below said surface of said water having openings to each slidably receive one of said pilings therethrough to permit vertical displacement thereon, a gate section above said surface of said water having apertures aligned with said openings to each slidably receive one of said pilings therethrough, said gate section having a lateral and vertical expanse to dissipate energy from each of said wakes, and struts connected to said flotation section and said gate section to extend through said surface of said water and to hold said gate section above said flotation section, said struts and said flotation section having composite buoyancy to hold said gate section a predetermined distance above said surface of said water.

7. A system according to claim 6 in which each barrier further includes:

an inclined ramp portion extending from said flotation section below said surface of said water, said inclined ramp portion progressively reducing the depth of the water above it as the distance to said flotation section becomes less to build up an incoming wake and assure clipping-off of crests of said wakes by said gate section.

8. A system according to claim 7 in which said pilings are oriented to present said inclined ramp portion toward said waterway region.

9. A system according to claim 8 in which said inclined ramp portion contributes to said composite buoyancy to hold said gate section said predetermined distance above said surface of said water.

10. A method of dissipating energy from wakes from high speed vessels comprising the steps of:

buoying a gate section above the surface of the water with a flotation section;

supporting said gate section a predetermined distance above said surface of said water with struts extending between said gate section and said flotation section;

orientating said gate section above said flotation section and said surface of said water;

slidably mounting said gate section and said flotation section on pilings extending through aligned apertures and openings in said gate section and said flotation section respectively; and clipping-off crests of said wakes with said gate section to thereby dissipate energy therefrom.

11. A method according to claim 10 further comprising the step of:

extending an inclined ramp portion from said flotation section below said surface of said water to progressively reduce the depth of water above it as the distance to said flotation section becomes less.

12. A method according to claim 11 further comprising the steps of:

building-up incoming wakes on said inclined ramp portion; and clipping-off crests of built-up incoming wakes by said gate section to thereby dissipate energy therefrom.

* * * * *